US005202523A

United States Patent [19]

Grossman et al.

[11] Patent Number: 5,202,523

[45] Date of Patent: Apr. 13, 1993

[54] FIREARM CLEANING SYSTEM

[76] Inventors: Dennis L. Grossman; Robert S. Grossman, both of 33 Edgewood Pl., Great Neck, N.Y. 11024

[21] Appl. No.: 737,393

[22] Filed: Jul. 29, 1991

[51] Int. Cl.[5] ..... F41A 29/00; B08B 3/12

[52] U.S. Cl. ..... 42/95; 134/1

[58] Field of Search ..... 42/95; 134/1, 105, 109, 134/110, 111, 137, 155, 166 R, 168 R

[56] References Cited

U.S. PATENT DOCUMENTS

| | | | |
|---|---|---|---|
| 2,982,524 | 5/1961 | Bland | 134/1 |
| 3,033,710 | 5/1962 | Hightower et al. | 134/1 |
| 3,158,886 | 12/1964 | Grimes | 134/1 |
| 4,045,900 | 9/1977 | Byer | 42/95 |
| 4,315,780 | 2/1982 | Rupp et al. | 42/95 |
| 4,404,979 | 9/1983 | Hobbs | 42/95 |
| 4,462,415 | 7/1984 | Otzen | 134/111 |
| 4,785,836 | 11/1988 | Yamamoto | 134/56 R |
| 4,940,494 | 7/1990 | Petit et al. | 134/1 |

*Primary Examiner*—Charles T. Jordan

*Attorney, Agent, or Firm*—Schweitzer Cornman & Gross

[57] ABSTRACT

An apparatus for the cleaning of firearms comprise a rack dimensioned to support a plurality of disassembled firearm elements within a tank. A cleaning fluid surrounds the firearm elements for the removal of ignition residue and other unwanted particles from the surfaces of the elements and placing the removed particles in suspension within the fluid. The fluid is agitated, such as by an ultrasonic source mounted to the tank, to enhance the contact between said cleaning fluid and said firearm elements. A pump provides for the flow of fluid within said tank, from the tank to an external filter, and from the filter back to the tank. The filter is adapted to remove the suspended particles from said solution and onto a replaceable filter media. The fluid can be heated to further improve cleaning performance.

6 Claims, 1 Drawing Sheet

FIREARM CLEANING SYSTEM

The present invention relates to an apparatus for the cleaning of firearms and, in particular, to a cleaning system utilizing a bath energized by ultrasonic energy to provide effective debris and residue removal from firearms.

BACKGROUND OF THE INVENTION

The operation of a firearm, resulting of an explosive charge within the firearm chamber followed by the exit from the chamber of a projectile at high speed, inherently results in the accumulation of debris and residue within the mechanism. Accumulation of such materials can inhibit proper operation of the firearm, and in the extreme case can result in misfire or damage to the firearm, and possible injury to the operator. Accordingly, proper safety practice dictates a regular program of cleaning.

Conventional cleaning is typically a manual process, in which the firearm is broken down and a cleaning patch, saturated with an appropriate solvent, is rubbed against the various surfaces of the firearm, the residue being removed from the surfaces adhering to the patch. After use, the patches must be discarded, and contain high levels of lead, as well as the residue of the typically toxic cleaning solvents employed.

While the firearm is to be broken down or disassembled for efficient cleaning, in practice this does not always occur. In attempts to save time, for example, cleaning of the barrel alone is often performed. Accordingly, accidents occur when a cleaning patch is driven down the barrel of the firearm into contact with a live round, the round being forced onto the firing pin resulting in an accidental discharge. Alternatively, during the cleaning process of a non-broken down firearm the possibility exists that the firing mechanism can be accidentally triggered. In either case, the results can be disastrous.

In addition to manual cleaning, an ultrasonically driven system is known. This method utilizes a highly volatile solvent sold under the trade name Break Free. Because of the high volatility of the solvent, cooling of the solution is often required. Replacement and replenishment of the solution is required on a periodic basis.

It is accordingly a purpose of the present invention to provide a cleaning apparatus which eliminates the need for highly toxic and volatile cleaning solvents.

Yet another purpose of the present invention is to provide a cleaning apparatus which provides a higher level of cleaning with less operator effort than conventional methods.

Still another purpose of the present invention is to provide a cleaning apparatus in which the firearm is placed in a non-operable condition to insure that accidental discharge of the firearm does not occur.

Still a further purpose of the present invention is to provide such an apparatus where the potentially toxic residues removed from the firearm can be collected so that they may be disposed of in a safe and proper manner.

BRIEF DESCRIPTION OF THE INVENTION

In accordance with the above and other objects and purposes, the present invention comprises a cleaning tank in which a rack supporting a disassembled firearm is placed. A high flash point, low toxicity cleansing solution is utilized, which dislodges the residue from the surfaces of the firearm and suspends the residue in solution, rather than dissolving it.

To provide an enhanced cleaning function, the cleansing solution is subject to ultrasonic vibration applied to the tank wall. The solution is further circulated through the tank by use of a circulator pump, the pump being placed in series with a filter having a removable filter media to trap the suspended particles and remove them from the circulating cleaning solution prior to its return to the cleaning tank. The combination of ultrasonic vibration, solution circulation and filtration of a non-reactive cleanser results in a high level of cleaning, the solution being usable for long periods of time and the suspended particles being able to be disposed of upon replacement of the filter media in a safe and environmentally sound manner.

DESCRIPTION OF THE DRAWINGS

A fuller understanding of the present invention will be achieved upon consideration of the following detailed description of a preferred, but nonetheless, illustrative embodiment of the invention when reviewed in conjunction with the annexed drawings, wherein.

DETAILED DESCRIPTION OF A PREFERRED EMBODIMENT

Figure 1:
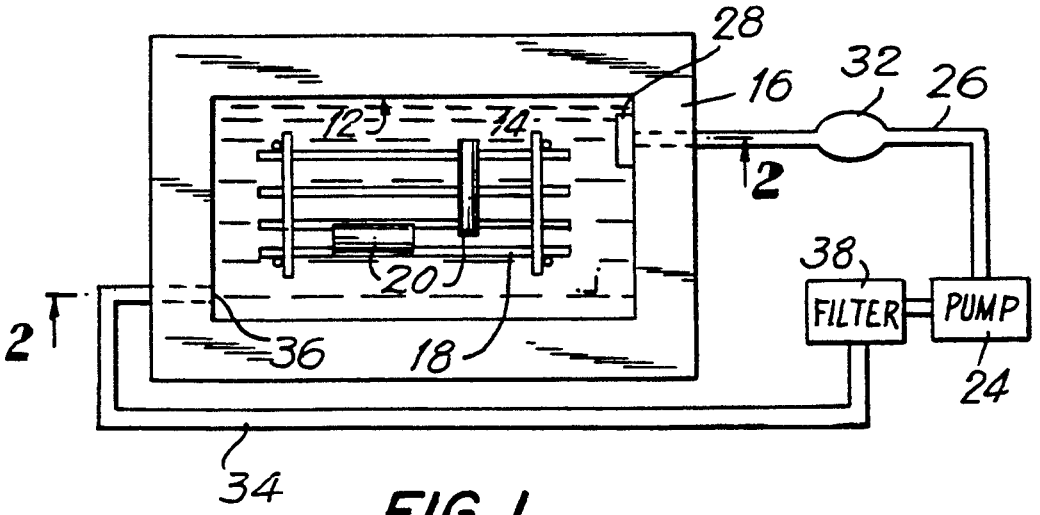
FIG. 1 is a top plan view illustrating the present invention.
Figure 2:
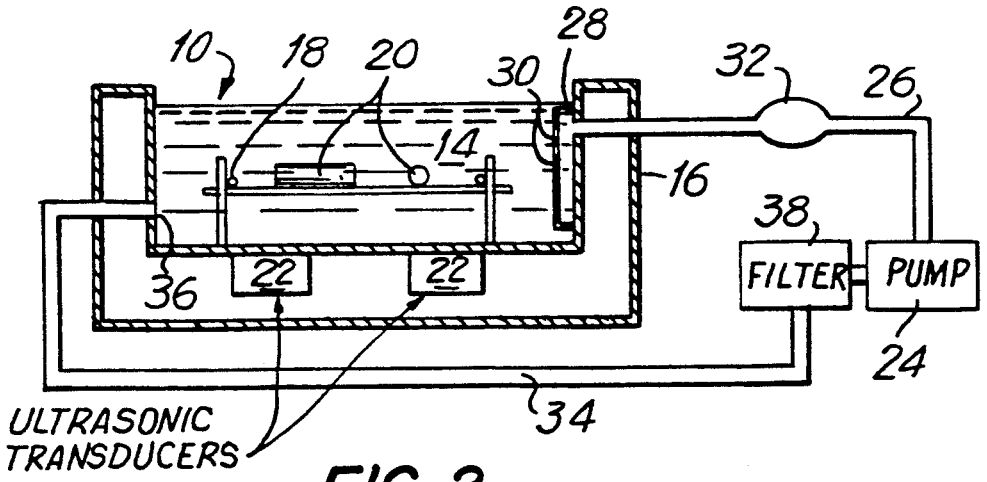
FIG. 2 is an elevation view in section taken along line 2—2 in FIG. 1.

As set forth in the figures, the present invention utilizes a cleaning tank unit 10 of interior dimensions chosen to be appropriate for the size and quantity of firearm elements to be treated. Preferably, the tank shell 12 is constructed of a rigid material, such as stainless steel, which transmits ultrasonic energy without significant dampening and is inert and non-reactive with the cleaning solution 14 utilized. The tank shell is mounted in and supported by an appropriate outer housing 16. A rack 18 is removably positioned within the tank and is preferably in the form of a grid-like structure adapted to support the individual firearm elements 20 to be cleansed by the solution bath. The rack is preferably coated with a resilient non-reactive plastic coating to provide a scratch-free surface for the firearm elements.

One or more electrically-driven, ultrasonic transducer elements 22 are mounted to the outer surface of the tank shell 12 in a manner known in the art. Activation of the transducers 22 creates a traveling wave pattern through the solution 14, enhancing the collision and contact between the solution molecules and the residue on the firearm elements, promoting the dislodging and removal of the residue from the firearm surfaces and its suspension in the cleaning media.

The cleaning solution 14 utilized consists of a combination of petroleum base cleansing oil and other cleansing agents, resulting in the removal of firing and other unwanted residues from the firearm element surfaces and their remaining in suspension within the solution, rather than being dissolved therein. In particular, a blend of the products sold under the trade name Formula 3 Gun Oil by Bay Oil Company and EEZOX Premium Gun Care of EEZOX, Inc. provides an appropriate combination with the further benefits of relatively low toxicity and inflammability. A solution prepared in a 4:1 ratio has been found particularly effective.

Such a solution also leaves a lubricating film on the element surfaces.

The solution is circulated through the tank by a pump 24, which is preferably of the magnetic type allowing full isolation of the impeller portion of the pump from the motor drive unit. Such pumps are known in the art. The pump exhausts through outlet pipe 26 connected to a manifold 28 aligned vertically upon a side wall of the tank 10. The manifold is provided with a series of apertures 30 through which the returning solution enters the tank at different heights. As magnetic pumps are typically not self-priming, a priming bulb 32 may be placed in the outlet pipe 26 to provide for an initial flow through the pump upon start-up. Typically, such a priming bulb 32 would include an internal check valve (not shown) to prevent back-flow through the pump during priming.

The inlet to the pump 24 is through pipe 34, the mouth 36 of which is located at a lower end of the tank, preferably on the side wall opposite the exit manifold 28. Such a location facilitates the development of a generally circular flow of solution within the tank, further assisting in the wash of the firearm elements 20 by the cleaning solution. The inlet pipe 34 directs the fluid through filter 38, which removes the suspended particles from the cleaning solution prior to the solution being drawn through the pump 24 and being returned to the tank through the manifold 28. The filter preferably includes a replaceable filter media having a pore size sufficient to remove particles down to approximately 10 to 20 microns in diameter. When the filter media becomes sufficiently loaded with residue, it may be removed from the unit and disposed of or provided for recycling of the residue materials as required or appropriate.

In its initial state, the combination of liquids utilized in the cleaning solution is somewhat viscous. Upon operation of the transducer, however, the temperature of the solution rises, lowering the viscosity and allowing for a more efficient flow of the fluid through the apparatus. It has been found that the increased temperature further enhances the efficiency of the cleaning operation. In prototype experiments, it has been found that under continuous operation an increase in temperature of approximately 45 degrees Celsius has been observed. Because of the low volatility and high boiling point of the solution, such rise does not result in solution evaporation, while the performance of the system is enhanced. Depending on the level of debris accumulation on the firearm surfaces, a cleaning cycle of approximately 20–30 minutes has been found sufficient. After removal from the tank, the firearm elements need only be drained, wiped down and reassembled.

The present invention allows a firearm to be cleaned in an environmentally responsible manner with enhanced results over conventional methods. As modifications and adaptations to the embodiment set forth herein, within the scope of the invention, may suggest themselves to those skilled in the art, the scope of the invention is to be measured by the following claims.

We claim:

1. An apparatus for the cleaning and lubrication of firearms, comprising a rack dimensioned to support a plurality of disassembled firearm elements, a tank dimensioned to accept said rack, said tank having a bottom surface surrounded by an upstanding side wall; an oil-based fluid mixture having lubricating and cleaning components within said tank and surrounding said firearm elements for the removal of ignition residue and other unwanted particles from the surfaces of said firearm elements and placing said removed particles in suspension within the fluid while providing a lubricating film thereon; means for enhancing the contact between said fluid and said firearm elements; and pump means for providing a flow of said fluid within said tank, from said tank to filter means and from said filter means to said tank; said filter means adapted to remove said suspended particles from said solution and onto a filter media portion of said filter means external to said tank.

2. The apparatus of claim 1, wherein said pump is coupled to a manifold for returning solution to said tank at a plurality of vertical locations and to an inlet pipe removing solution from said tank from a point adjacent said tank bottom.

3. The apparatus of claim 2, wherein said manifold and inlet pipe are located on opposite ends of said tank.

4. The apparatus of claim 2, wherein said contact enhancement means comprises ultrasonic wave-generating means.

5. The apparatus of claim 4, further comprising heating means for said cleaning fluid.

6. The apparatus of claim 5, wherein said heating means comprises second ultrasonic wave-generating means.

* * * * *